United States Patent [19]

Katz et al.

[11] 4,395,292

[45] Jul. 26, 1983

[54] HIGH FRUCTOSE SYRUP AND PROCESS FOR MAKING SAME

[75] Inventors: Edward Katz, St. Louis County; Henry S. Davis, St. Louis; Barrett L. Scallet, Clayton, all of Mo.

[73] Assignee: Anheuser-Busch, Incorporated, St. Louis, Mo.

[21] Appl. No.: 459,788

[22] Filed: Apr. 10, 1974

[51] Int. Cl.[3] ..... C13K 1/00; C13K 11/00

[52] U.S. Cl. ..... 127/29; 127/30; 127/46.3; 435/94

[58] Field of Search ..... 127/30, 46 B, 29, 41, 127/46.3; 426/213, 380; 195/31 F

[56] References Cited

U.S. PATENT DOCUMENTS

| | | | |
|---|---|---|---|
| 2,069,064 | 1/1937 | Gore et al. | 127/30 |
| 3,044,904 | 7/1962 | Serbia | 127/46 B |
| 3,044,905 | 7/1962 | LeFevre | 127/46 B |
| 3,305,395 | 2/1967 | Scallet et al. | 127/30 |
| 3,416,961 | 12/1968 | Mountfort et al. | 127/30 X |
| 3,432,345 | 3/1969 | Tsao et al. | 127/30 X |
| 3,483,031 | 12/1969 | Lauer et al. | 127/41 |
| 3,806,363 | 1/1974 | Takasaki | 127/41 X |
| 3,910,821 | 10/1975 | Cory | 127/30 |

FOREIGN PATENT DOCUMENTS

| | | | |
|---|---|---|---|
| 1267119 | 3/1972 | United Kingdom | 127/29 |

*Primary Examiner*—Sidney Marantz

*Attorney, Agent, or Firm*—Gravely, Lieder & Woodruff

[57] ABSTRACT

A non-crystallizing starch conversion syrup which is rich in fructose and a method of treating a syrup derived from corn or other starch to increase the fructose content of the syrup. The method involves the molecular separation of fructose from dextrose by treating a fructose-dextrose feed syrup. The first component stripped out by the separation process is a dextrose rich component containing most of the higher molecular weight sugars, and thereafter an enriched fraction is recovered which consists mostly of fructose, a lesser amount of dextrose, and only a trace of other sugars.

20 Claims, 1 Drawing Figure

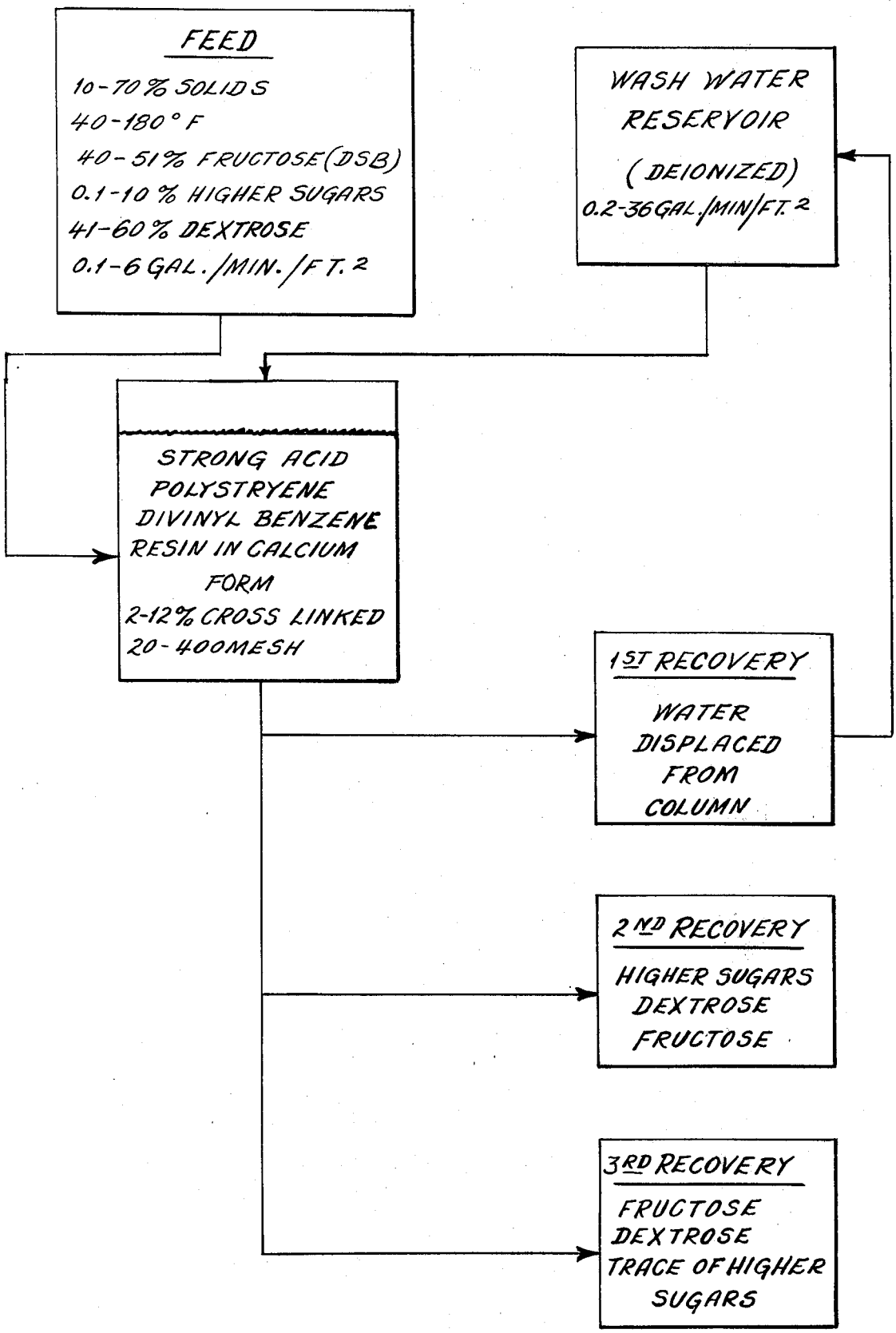
FEED
10-70% SOLIDS
40-180° F
40-51% FRUCTOSE (DSB)
0.1-10% HIGHER SUGARS
41-60% DEXTROSE
0.1-6 GAL./MIN./FT.2
WASH WATER RESERVOIR
(DEIONIZED)
0.2-36 GAL./MIN/FT.2
STRONG ACID POLYSTRYENE DIVINYL BENZENE RESIN IN CALCIUM FORM
2-12% CROSS LINKED
20-400 MESH
1ST RECOVERY
WATER DISPLACED FROM COLUMN
2ND RECOVERY
HIGHER SUGARS
DEXTROSE
FRUCTOSE
3RD RECOVERY
FRUCTOSE
DEXTROSE
TRACE OF HIGHER SUGARS

HIGH FRUCTOSE SYRUP AND PROCESS FOR MAKING SAME

BACKGROUND OF THE INVENTION

In Scallet et al U.S. Pat. No. 3,305,395 there is disclosed and claimed a molecular exclusion and ion exclusion process resulting from the alkali isomerization of a high D.E. feed. The product of this invention, while quite useful and unique, contains a substantial percent of disaccharides and higher sugars. The present invention provides a process for obtaining a product even higher in fructose and lower in higher saccharides and higher sugars. Also, assigned to assignee of this invention are Katz U.S. Pat. Nos. 3,684,574 and 3,690,948 which disclose high fructose containing syrups made by resin isomerization processes. The products of these inventions are suitable as feed products for the present invention as are the products made according to the enzyme isomerization process of co-pending applications Ser. Nos. 218,476 and 296,000 of Shieh et al.

The state of the art of separation of fructose from glucose in conventional invert sugar, i.e., sugar made from sucrose solutions, is shown in Serbia U.S. Pat. Nos. 3,044,904 and Melaja 3,692,582. Both of these patents relate to invert feeds which means that the feed and also the final products contain sucrose. Also, the throughput of the processes of these patents is quite low compared to the throughput needed for an economical process using a corn conversion syrup.

An advantage of the improved process of this invention is its economic feasibility as well as the production of a product with a high fructose content, lower polysaccharide content and low dextrose content to permit a higher solids level in the finished product without crystallization of dextrose. The product of this invention is a syrup containing at least about 52% fructose (preferred at least 55% fructose) which can be concentrated to 80% or higher dry solids to yield a non-crystallizing syrup at a higher solids level and fructose level than present commercially available isomerized syrups.

SUMMARY OF THE INVENTION

The present invention comprises a process for separating a high fructose, non-crystallizing syrup from a feed syrup containing 52% or less fructose, said feed syrup having a high dextrose content and preferably being derived from corn starch. The present invention further comprises a process that utilizes molecular exclusion to separate a large proportion of the higher molecular weight sugars from a feed syrup and allows the recovery of a non-crystallizing syrup containing mostly fructose, some dextrose, and only trace amounts of higher molecular weight sugars.

Accordingly, it is an object of the present invention to separate a fructose rich syrup from a fructose-dextrose mixture utilizing a molecular separation process at a high throughput rate. Another object of the present invention is to provide a practical and efficient method of obtaining a 52% or higher fructose syrup from a 52% or less fructose feed syrup, said feed syrup being either a molecular exclusion product or a dextrose-fructose syrup, and preferably being a high fructose syrup derived from a high dextrose syrup made from starch, preferably corn starch. Still another object of the present invention is to produce a superior tasting fructose product which is substantially free of high molecular weight sugars and is suitable for a variety of food applications. Yet another object of the present invention is to provide a high fructose syrup containing 55% or more fructose at 80% solids (DSB).

DETAILED DESCRIPTION

This invention involves a commercially practical and efficient method of obtaining a superior quality syrup with 52% or more fructose from a feed syrup containing 52% or less fructose. The feed syrup is obtained by isomerizing either dextrose or preferably a high dextrose syrup derived from starch (preferably corn starch). The isomerization process can be resin isomerization, alkali isomerization, or preferably enzyme isomerization.

We use a molecular exclusion process to separate many of the non-fructose sugars from the fructose, leaving a product richer in fructose than the feed and containing lower quantities of the other sugars. The actual sugar composition depends on operating conditions, feed composition, and the selected cutoff point. This separation process removes most of the higher molecular weight sugars, thus allowing the recovery of a high fructose non-crystallizing syrup containing mostly fructose, some dextrose and no more than a trace of higher molecular weight sugars. This syrup is of high quality and is suitable as a sucrose substitute.

In the process of this invention, the starting material used to prepare a 52% or higher fructose syrup product is a feed syrup containing about 25% to about 51% fructose. This feed syrup can be obtained from an alkali isomerization as set forth in U.S. Pat. No. 3,285,776, a resin isomerization (see Example I) as set forth in U.S. Pat. Nos. 3,684,574 and 3,690,948, a previous exclusion process, or an enzyme isomerization as described in pending U.S. application Ser. Nos. 218,476 and 296,000. Feed syrups from enzyme isomerization processes are the preferred sources, because of economy and the higher fructose levels available from these sources. (See Examples 2–11).

A preferred procedure for preparing feed syrup is as follows:

Starch, preferably corn starch, is converted by an acid-enzyme or enzyme-enzyme process to a high dextrose equivalent or D.E. (over a 90 D.E.) syrup containing mostly dextrose. The dextrose syrup may be derived from crystallized dextrose, redissolved and used as the feed in one of the previously indicated isomerization processes. The preferred procedure is to enzyme isomerize a 95+ D.E. syrup to a fructose level of about 45% to about 50%. The feed syrup is then purified by carbon treatment and ion exchange in preparation for the molecular exclusion process. Using the preferred 95+ D.E. syrup to prepare the fructose containing feed, the feed syrup will normally contain fructose, dextrose, and usually about 3% to about 10% higher molecular weight sugars, mainly disaccharides.

However, the feed syrup will contain, in addition to fructose and dextrose, only a trace of higher molecular weight sugars when crystalline dextrose or 95+ dextrose syrup is used to prepare the feed containing fructose.

The feed material is fed into a column (top to bottom flow preferred) which contains a resin bed of strong acid polystyrene divinyl benzene resin in the calcium, barium or strontium form. The calcium form of the resin is preferred because it is recognized as a safe material for food products. Use of barium or strontium may require further treatment, such as ion exchange to remove any metallic ions in the finished material. The portion of the column containing the resin bed is filled with deionized water, so that the bed is covered with water. The resin has about 2% to about 12% cross-linkage, with about 4% cross-linkage being preferred. The bed depth of resin is preferably greater than about 18 inches. The resin mesh size is about 20 to about 400 mesh, with about 50 to about 100 mesh being preferred. The column can be operated at atmospheric pressure with air above the top of the resin between the resin and the inside of the top of the column, with pressurized air in the space above the top of the resin (air dome), or with water in the space above the top of the resin and below the inside of the top of the column (water dome). The feed is pumped into a feed distributor located slightly below the air-resin or water-resin interface and liquor is discharged through a suitable collection mechanism at the bottom of the column.

The feed syrup can be about 10% to about 70% solids basis, but about 40% is preferred. Feed syrup, rinse water and column temperatures can be about 40° to about 180° F., but about 110° to about 140° F. is preferred. Any level of fructose can be used as feed, but the preferred feed is about 40% to about 51% fructose, about 0.1% to about 8% higher sugars and the remainder dextrose. Multiple passes through the column to enrich the feed in fructose can be used, but one single pass is preferred for economic reasons. Syrup feed flow rates are about 0.1 to about 6.0 gal./min./ft.$^2$ with about 0.6 to about 2.0 gal./min./ft.$^2$ preferred. The flow rate of the rinse water is limited only by the geometry of the column, type of resin and pressure drop limitations. The rinse water rate can be changed (preferably increased to a higher rate) after the first composite fraction is collected. If the rate is increased, the column is cleared faster and a greater throughput of feed is achieved in a lesser time cycle.

The operating procedure is as follows:

The column, feed syrup in the feed tank, and rinse water in the rinse tank are all brought to operating temperatures of about 140° F. Ion-exchanged feed syrup is pumped into the column (preferably top to bottom) at 0.1 to about 6 gal./min./ft.$^2$ range. The feed syrup is discharged into the column through a distributor positioned just beneath the top surface of the resin. Water displaced from the resin bed is first discharged out of the bottom or the discharge end of the column. This water can be diverted for reuse in the process. After the proper amount of feed has been pumped into the column at the proper flow rate, deionized rinse water is pumped preferably into the top of the column when a water dome is used. The rinse water is not conducted into the feed distributer below the top of the resin bed in order to avoid disturbing the bed. On the discharge end, the displaced water is followed by a fraction rich in high molecular weight sugars and dextrose. This composite fraction of dextrose rich liquor and higher molecular weight sugars is collected in a separate receiver until an appropriate predetermined cut-off point is reached. This cut-off point is determined by the desired product composition. At the cut-off point the composite analysis of sugars left in the column represents the desired product composition, preferably about 55 to about 80% fructose. At this point, the effluent is transferred to the product receiver.

At the cut-off point, the rinse rate can be about 0.2 to about 36 gal./min./ft.$^2$. It can remain constant compared to the syrup feed rate but preferably is increased to as high a rate as the system can tolerate. The higher rates of rinse will not disturb the column because the rinse water enters the column in the water dome portion at the top of the column. Although increasing product dilution somewhat, the higher rate reduces cycle time considerably and increases column output. A product containing over 90% fructose composite can be obtained in the one throughput or pass, if about 40 to about 51% (preferably 45% or higher) fructose feed is used (see Examples 5, 6, 7, 8). Although a number of fractions of different compositions could be collected (see Examples 1–10), it is preferred to collect two composite fractions; the first of which represents dextrose rich stripped out sugars, and the second being the high fructose product. The rinse flow can be terminated when the product effluent drops below 1% DSB. The column is now ready for additional consecutive cycles identical to the first with no other preparation.

The process can be run at a constant flow rate but an increased flow rate is preferred after the first composite fraction effluent is collected. More than two different flow rates are possible, but two are sufficient from a practical viewpoint.

The three fractions preferably collected in the following order are:

1. Displaced water
2. Stripped out sugars rich in dextrose
3. High fructose product composite Using the preferred procedures, cycle times of less than 1 hour per batch are possible in a column having a bed depth of 5 feet or more.

Composite analysis of the product and first fractions are given in the Examples. The high fructose product effluent composite can be concentrated to a commercial solids level by conventional processing methods. If the selected product is over 55% fructose, a non-crystallizing solids level of over 80% dry solids can be attained.

Following are specific examples of this invention:

EXAMPLE NO. 1

Example No. 1 depicts the enrichment of fructose from a resin-isomerized fructose-dextrose syrup using a one flow rate process.

About 845 cc of a resin isomerized fructose-dextrose syrup containing 29.2% fructose is transferred to an exclusion column at a rate of 0.2 gal./min./ft.$^2$. Deionized water at the same flow rate is used to wash out the syrup from the column. The first fraction eluted contains about 800 cc of sugar free water. Next, successive 100 cc fractions are collected separately and the sugar content determined by conventional analysis methods. Following are the operating conditions used in this Example No. 1 and the results are shown in Tables I and IA which follow.

| OPERATING CONDITIONS | |
|---|---|
| Pressure | Atmospheric |
| Temp. | 72–75° F. |
| Flow Rate | 0.2 gal./min./ft.$^2$ |
| Column Diameter | 2.0 inches |
| Resin | *Dowex 40 w - X4, Sr++ form, 50–100 mesh |
| Resin Bed Depth | 42 inches |
| Bed Loading Volume | 38% of resin volume at 40% DSB |
| Feed Syrup | Resin Isomerized |
| D.E. | 92.6 |
| Fructose | 29.2 |

-continued

| OPERATING CONDITIONS | |
|---|---|
| Dextrose | 57.4 |
| Higher Sugars | 13.4 |
| DSB | 40.3 |
| pH | 4.0 |
| Volume (cc) | 845 |

*Dowex 50 w - X4 is a strong acid polystyrene divinyl benzene resin manufactured by Dow Chemical Company. It can be converted to the calcium, barium and strontium forms and the particle size is 50–100 mesh.

TABLE I

| | | Composition of Successive 100 cc Fractions Collected | | | | | | |
|---|---|---|---|---|---|---|---|---|
| Fraction | Volume cc | % DSB | Gms DSB | % Dextrose | % Fructose | Gms DSB Dextrose | Gms DSB Fructose | Gms DSB Higher Sugars |
| Feed | 845 | 40.4 | 403.0 | 57.4 | 29.2 | 231.0 | 118.0 | 54.0 |
| Occluded | 800 | 0.6 | 4.8 | — | — | — | — | — |
| 1 | 100 | 1.3 | 1.3 | — | — | — | — | — |
| 2 | 100 | 2.4 | 2.4 | 4.0 | — | .10 | — | — |
| 3 | 100 | 4.1 | 4.2 | 27.4 | — | 1.2 | — | — |
| 4 | 100 | 8.4 | 8.7 | 56.3 | — | 4.9 | — | — |
| 5 | 100 | 14.1 | 14.9 | 72.2 | — | 10.8 | — | — |
| 6 | 100 | 20.1 | 21.8 | 76.0 | 4.5 | 16.6 | 1.0 | 4.3 |
| 7 | 100 | 25.2 | 27.9 | 76.5 | 6.0 | 21.3 | 1.7 | 6.6 |
| 8 | 103 | 28.4 | 32.8 | 76.1 | 9.3 | 25.0 | 3.0 | 4.8 |
| 9 | 100 | 31.4 | 35.7 | 72.7 | 12.6 | 26.0 | 4.5 | 5.3 |
| 10 | 100 | 32.0 | 36.4 | 71.0 | 18.0 | 25.8 | 6.6 | 4.0 |
| 11 | 100 | 28.8 | 32.3 | 63.3 | 26.0 | 20.5 | 8.4 | 3.5 |
| 12 | 100 | 28.4 | 31.8 | 56.2 | 29.7 | 17.9 | 9.4 | 4.5 |
| 13 | 102 | 26.0 | 29.4 | 56.8 | 35.4 | 16.7 | 10.4 | 2.3 |
| 14 | 102 | 23.4 | 25.7 | 51.3 | 41.7 | 13.2 | 10.7 | 1.8 |
| 15 | 102 | 21.0 | 22.8 | 44.6 | 46.8 | 10.2 | 10.7 | 2.0 |
| 16 | 102 | 17.6 | 18.9 | 39.3 | 56.0 | 7.4 | 10.6 | 0.9 |
| 17 | 102 | 14.1 | 14.9 | 28.4 | 65.4 | 4.2 | 9.7 | 0.9 |
| 18 | 102 | 9.1 | 9.4 | 15.9 | 75.1 | 1.5 | 7.1 | 0.9 |
| 19 | 102 | 6.1 | 6.2 | 7.4 | 74.5 | 0.5 | 4.6 | 1.1 |
| 20 | 102 | 3.9 | 4.0 | 4.7 | 75.0 | 0.2 | 3.0 | 0.8 |
| 21 | 102 | 2.9 | 2.9 | 3.7 | 64.5 | 0.1 | 1.9 | 0.9 |
| 22 | 102 | 2.1 | 2.1 | — | 60.5 | — | 1.3 | 0.8 |
| 23 | 102 | 1.8 | 1.8 | — | 59.0 | — | 1.1 | 0.8 |
| 24 | 102 | 1.8 | 1.8 | — | 58.2 | — | 1.1 | 0.8 |

TABLE IA

| | Summation of Fractions Taken in Table I | | | | |
|---|---|---|---|---|---|
| Composite Fractions | Gms DSB Fructose | Gms DSB Dextrose | Total Gms DSB | % Fructose | % Dextrose |
| Feed | 118.0 | 231.0 | 403.0 | 29.2 | 57.4 |
| 3-24 | 106.6 | 273.8 | 388.0 | 27.5 | 57.5 |
| 4-24 | 106.6 | 222.6 | 383.8 | 27.8 | 58.1 |
| 5-24 | 106.6 | 217.7 | 375.1 | 28.4 | 57.9 |
| 6-24 | 106.6 | 206.9 | 360.2 | 29.4 | 57.1 |
| 7-24 | 105.6 | 190.4 | 338.4 | 31.2 | 56.2 |
| 8-24 | 104.0 | 169.0 | 308.9 | 33.6 | 54.8 |
| 9-24 | 100.9 | 144.1 | 276.1 | 36.4 | 52.2 |
| 10-24 | 96.4 | 118.1 | 240.4 | 39.4 | 48.3 |
| 11-24 | 89.9 | 92.3 | 204.0 | 44.0 | 45.0 |
| 12-24 | 81.5 | 71.8 | 171.7 | 47.0 | 41.8 |
| 13-24 | 72.1 | 54.0 | 139.9 | 51.6 | 38.5 |
| 14-24 | 61.6 | 37.3 | 110.5 | 55.8 | 33.7 |
| 15-24 | 50.9 | 24.1 | 84.8 | 60.0 | 24.8 |
| 16-24 | 40.3 | 13.9 | 62.0 | 64.8 | 22.4 |
| 17-24 | 29.7 | 6.5 | 43.1 | 67.8 | 15.0 |
| 18-24 | 19.9 | 2.3 | 28.2 | 70.7 | 7.9 |
| 19-24 | 12.9 | 0.8 | 18.8 | 68.3 | 4.0 |
| 20-24 | 8.3 | 0.3 | 12.6 | 65.4 | 2.4 |
| 21-24 | 5.3 | 0.1 | 8.6 | 61.0 | 1.1 |
| 22-24 | 3.4 | — | 5.7 | 59.2 | — |
| 23-24 | 2.1 | — | 3.6 | 58.5 | — |

A fructose-dextrose syrup can be obtained which contains a fructose content ranging from 5.0% to 75% by combining the appropriate fractions or using a single fraction. For instance, a fructose-dextrose syrup containing 55.8% fructose can be obtained by combining fractions 14–24 as seen in Table IA.

EXAMPLE NO. 2

This example shows the enrichment of fructose from an enzyme isomerized fructose-dextrose syrup using a two-flow rate hydraulic dome process.

About 4719 cc of an enzyme isomerized fructose-dextrose syrup containing 42.8% fructose is charged to a water containing, resin filled, exclusion column at an initial flow rate of 0.2 gal./min./ft.$^2$. The eluted first fraction resulting from charging of the syrup contains about 6500 cc of sugar-free water. At this point, collection of first sugar containing fractions is begun. The rinse cycle using deionized water at the same flow rate is begun simultaneously when the feed cycle ends. Fractions numbered 1 to 4 of 1000 cc each and the first 300 cc of fraction 5 are collected separately at this initial flow rate and the percentage of the composite sugars collected is determined by conventional analysis methods known in the art. The results of this first composite collection are shown in Table II.

At this point in the cycle, the composite of fructose-dextrose sugars remaining in the column represent a fructose-dextrose syrup with a fructose content of approximately 55%. The flow rate now is increased to 1.5 gal./min./ft.$^2$ to rapidly wash this fructose enriched syrup composite from the column. This is shown in Table II in the line headed 5.3–12. This collection is made rapidly and is important because it allows the column to be reused for another cycle far more quickly than if the column is eluted entirely at the initial flow rate.

Using this procedure a fructose-dextrose composite syrup with a lesser or greater ratio of fructose to dextrose can be obtained by changing the cut-off point where the effluent stream is diverted to another receiver and the column is rapidly eluted.

| OPERATING CONDITIONS | |
|---|---|
| Process Operation | Hydraulic Dome |
| Temp. | 125° F. |
| Flow Rate | Two flow, 0.2–1.5 gal./min./ft.$^2$ |
| Column Diameter | 4.0 inches |
| Resin | Dowex 50 w - X4, Ca++ form 50–100 mesh |
| Resin Bed Depth | 60 inches |
| Bed Loading Volume | 38% of resin volume at 40% DSB |
| Feed Syrup | Enzyme Isomerized |
| D.E. | 94.5 |
| Fructose | 42.8 |
| Dextrose | 52.3 |
| DSB | 40.0 |
| pH | 3.9 |
| Volume (cc) | 4719 |

TABLE II

| Fraction | Volume cc | % DSB | Gms DSB | % Fructose | Gms DSB Fructose |
|---|---|---|---|---|---|
| Feed | 4719 | 40.0 | 2206 | 42.8 | 944.0 |
| Occluded | 6500 | — | — | — | — |
| 1 | 1000 | 1.9 | 19.0 | 0.6 | 0.1 |
| 2 | 1000 | 7.4 | 75.7 | 4.2 | 3.2 |
| 3 | 1000 | 17.9 | 190.9 | 4.7 | 9.0 |
| 4 | 1000 | 25.8 | 284.2 | 13.3 | 37.8 |
| 5.0–5.3 | 300 | 30.0 | 100.9 | 27.4 | 27.6 |
| 5.3—12 | 7700 | 18.3 | 1505.2 | 54.9 | 826.4 |

This example illustrates a two-flow elution process. The initial constant flow rate of 0.2 gal./min./ft.$^2$ is used through fraction 5.3. The flow rate is then increased to 1.5 gal./min./ft.$^2$ to collect fractions 5.3–12.

Any of the exclusion process operations can be used with equal results, i.e., atmospheric pressure, air dome, and water dome, however, the preferred method is with the water dome since it is more easily adapted to continuous operation.

EXAMPLE NO. 3

This example shows the enrichment of fructose from an enzyme isomerized fructose-dextrose syrup using a volume of feed equivalent to 50% of the resin volume.

About 6128 of a fructose-dextrose syrup containing 43.8% fructose is transferred to an exclusion column at a rate of 0.2 gal./min./ft.$^2$. It is washed from the column with deionized water at the same rate. The first fraction eluted contains about 7000 cc of sugar free water. Next, successive 1000 cc fractions are collected separately and the sugar content determined by methods known in the art. Following are the operating conditions used in this example. The results of analyzing the collected fractions are shown in Table III, while Table IIIA shows a summation of fractions to yield high fructose syrups. In Table IIIA the last fraction is combined with each preceding fraction.

| OPERATING CONDITIONS | |
|---|---|
| Pressure | Atmospheric |
| Temp. (°F.) | 125 |
| Flow Rate | 0.2 gal./min./ft.$^2$ |
| Column Diameter | 4.0 inches |
| Resin Bed Depth | 60.0 inches |
| Resin | Dowex 50 w - X4, Ca++ form, 50–100 mesh |
| Bed Loading Volume | 50% of resin volume at 40.0% DSB |
| Feed Syrup | Enzyme Isomerized |

-continued

| OPERATING CONDITIONS | |
|---|---|
| D.E. | 94.0 |
| Fructose | 43.8 |
| Dextrose | 52.9 |
| DSB | 40.4 |
| pH | 3.9 |
| Volume (cc) | 6128.0 |

TABLE III

| Fraction | Volume CC | % DSB | Gms DSB | % Dextrose | % Fructose | Gms DSB Dextrose | Gms DSB Fructose |
|---|---|---|---|---|---|---|---|
| Feed | 6128 | 40.4 | 2898.6 | 52.9 | 43.8 | 1533.4 | 1269.6 |
| Occluded | 7000 | — | — | — | — | — | — |
| 1 | 1000 | 2.2 | 22.0 | 44.6 | 7.8 | 9.8 | 1.7 |
| 2 | 1000 | 9.8 | 101.2 | 79.0 | 4.0 | 79.9 | 4.0 |
| 3 | 1000 | 21.2 | 229.2 | 84.4 | 5.4 | 193.4 | 12.4 |
| 4 | 1000 | 28.6 | 318.7 | 75.3 | 17.0 | 240.0 | 54.2 |
| 5 | 1000 | 35.8 | 411.1 | 61.2 | 34.6 | 251.6 | 142.2 |
| 6 | 1000 | 38.6 | 448.6 | 56.2 | 44.4 | 252.1 | 199.2 |
| 7 | 1000 | 37.2 | 429.7 | 50.2 | 49.5 | 215.7 | 212.7 |
| 8 | 1000 | 33.3 | 378.3 | 42.7 | 57.3 | 161.5 | 216.8 |
| 9 | 1000 | 27.9 | 310.0 | 31.1 | 70.7 | 96.4 | 219.2 |
| 10 | 1000 | 17.4 | 184.9 | 11.4 | 87.0 | 21.1 | 160.9 |
| 11 | 1000 | 3.6 | 43.5 | 5.6 | 95.7 | 2.4 | 41.6 |

TABLE III-B

| Composite Fractions | Gms DSB Fructose | Gms DSB Dextrose | Total Gms DSB | % Fructose | % Dextrose |
|---|---|---|---|---|---|
| Feed | 1269.6 | 1533.4 | 2898.6 | 43.8 | 52.9 |
| 1-11 | 1264.9 | 1523.9 | 2877.2 | 43.9 | 52.9 |
| 2-11 | 1263.2 | 1514.1 | 2855.2 | 44.2 | 53.0 |
| 3-11 | 1259.2 | 1434.2 | 2754.0 | 45.7 | 52.1 |
| 4-11 | 1246.8 | 1240.8 | 2524.8 | 49.4 | 49.1 |
| 5-11 | 1192.6 | 1000.8 | 2206.1 | 54.1 | 45.4 |
| 6-11 | 1050.4 | 749.2 | 1795.0 | 58.5 | 41.7 |
| 7-11 | 851.2 | 497.1 | 1346.4 | 69.7 | 30.7 |
| 8-11 | 638.5 | 281.4 | 916.7 | 69.7 | 30.7 |
| 9-11 | 421.7 | 119.9 | 538.4 | 78.3 | 22.3 |
| 10-11 | 202.5 | 23.5 | 228.4 | 88.7 | 10.3 |

At a 50% bed loading volume the resin has an effective capacity to yield a fructose-dextrose separation that is significant. A fructose-dextrose syrup can be obtained which contains a fructose content ranging from 4.0% to 95.7% by combining the appropriate fractions as a single composite fraction. Composite fractions and their respective fructose contents are shown.

EXAMPLE NO. 4

This example shows the enrichment of fructose from an enzyme isomerized fructose-dextrose syrup using an air dome process.

About 4557 cc of an enzyme isomerized fructose-dextrose syrup containing 41.9% fructose is transferred to an exclusion column at a rate of 4.0 gal./min./ft.$^2$. The column is maintained at 5.0 psi. The syrup is washed from the column with deionized water at the same rate and pressure. The first composite fraction eluted contains about 7000 cc of sugar-free water. Next, successive 2000 cc fractions are collected separately and the sugar content determined by methods known in the art. Following are the operating conditions used in this example.

The analyses of the eluted fractions are shown in Table IC. The IVB shows a summation of fractions to yield a high fructose syrup. The last fraction is combined with each preceding fraction in this Table.

| OPERATING CONDITIONS | |
|---|---|
| Process Operation | Air Dome |
| Temp. | 125° F. |
| Flow Rate | 4.0 gal./min./ft. |
| Column Diameter | 4.0 inches |
| Resin Bed Depth | 60.0 inches |
| Resin | Dowex 50 w - X4, Ca++ form, 50–100 mesh |
| Bed Loading Volume | 38% of resin volume at 40.0% DSB |
| Feed Syrup | Enzyme Isomerized |
| Fructose | 41.9 |
| Dextrose | 51.8 |
| pH | 3.6 |
| Volume (cc) | 4557. |

TABLE IV

| Fraction | Volume cc | % DSB | Gms DSB | % Dextrose | % Fructose | Gms DSB Dextrose | Gms DSB Fructose |
|---|---|---|---|---|---|---|---|
| Feed | 4557 | 41.2 | 2206 | 51.8 | 41.9 | 1142.7 | 924.3 |
| Occluded | 7000 | 0.3 | — | — | — | — | — |
| 1 | 2000 | 13.1 | 274.1 | 67.6 | 15.8 | 185.3 | 43.3 |
| 2 | 2000 | 24.7 | 541.7 | 62.8 | 30.7 | 340.2 | 166.3 |
| 3 | 2000 | 21.4 | 463.0 | 54.3 | 43.0 | 251.4 | 199.1 |
| 4 | 2000 | 18.5 | 395.6 | 48.0 | 50.0 | 190.0 | 197.8 |
| 5 | 2000 | 13.4 | 280.7 | 39.1 | 59.0 | 109.8 | 165.6 |
| 6 | 2000 | 4.8 | 97.2 | 28.2 | 70.4 | 27.4 | 68.4 |
| 7 | 2000 | 1.4 | 27.9 | 17.5 | 81.5 | 4.9 | 22.7 |

TABLE IV-B

Summation of Fractions

| Composite Fractions | Gms DSB Fructose | Gms DSB Dextrose | Total Gms DSB | % Fructose | % Dextrose |
|---|---|---|---|---|---|
| Feed | 924.3 | 1142.7 | 2206.0 | 41.9 | 51.8 |
| 1-7 | 864.1 | 1109.0 | 2080.2 | 41.5 | 53.3 |
| 2-7 | 820.8 | 923.7 | 1806.1 | 45.4 | 51.1 |
| 3-7 | 645.5 | 583.5 | 1264.4 | 51.8 | 46.1 |
| 4-7 | 455.4 | 332.1 | 801.4 | 56.8 | 41.4 |
| 5-7 | 256.7 | 142.1 | 405.8 | 63.3 | 35.0 |
| 6-7 | 91.1 | 32.3 | 125.1 | 72.8 | 25.8 |

A fructose-dextrose syrup can be obtained which contains a fructose content ranging from 15.0% to 8.15% by combining the appropriate fractions as a composite.

EXAMPLE NO. 5

This example shows the enrichment of fructose from an enzyme isomerized fructose-dextrose syrup with a fructose content of 43.3% on a 5 ft. column.

About 4732 cc of a fructose-dextrose syrup containing 43.3% fructose is transferred to an exclusion column at a rate of 0.1 gal./min./ft.$^2$. The syrup is washed from the column using deionized water at the same flow rate. The first fraction eluted contains about 5000 cc of sugar-free water. Next, successive 1000 cc fractions are collected separately and the sugar content determined by methods known in the art. Following are the operating conditions used in the example. The analyses of the collected fractions are shown in Table V. Table V-A shows a summation of fractions to yield high fructose syrups. The last fraction is combined with each preceding fraction in Table V-A.

| OPERATING CONDITIONS | |
|---|---|
| Pressure | Atmospheric |
| Temp. | 125° F. |
| Flow Rate | 0.5 gal./min./ft.$^2$ |
| Column Diameter | 4.0 inches |
| Resin Bed Depth | 60.0 inches |
| Resin | Dowex 50 w - X4, Ca++, 50–100 mesh |
| Bed Loading Volume | 38% of resin volume at 40.0% DSB |
| Feed Syrup | Enzyme Isomerized |
| D.E. | 94.5 |
| Fructose | 43.3 |
| Dextrose | 51.6 |
| DSB | 39.9 |
| pH | 4.1 |
| Volume (cc) | 4732. |

TABLE V

| Fraction | Volume (cc) | % DSB | Gms DSB | % Fructose | Gms DSB Dextrose | Gms DSB Fructose |
|---|---|---|---|---|---|---|
| Feed | 4732 | 39.9 | 2206.0 | 43.3 | — | 955.2 |
| Occluded | 5000 | — | — | — | — | — |
| 1 | 1000 | 0.7 | 7.0 | — | — | — |
| 2 | 1000 | 1.5 | 15.0 | 0.6 | — | 0.1 |
| 3 | 1000 | 6.2 | 63.1 | 5.0 | — | 3.2 |
| 4 | 1000 | 16.5 | 175.0 | 6.5 | — | 11.4 |
| 5 | 1000 | 25.5 | 280.5 | 18.5 | — | 51.9 |
| 6 | 1000 | 28.9 | 322.4 | 35.1 | — | 113.2 |
| 7 | 1000 | 28.1 | 312.5 | 44.6 | — | 139.4 |
| 8 | 1000 | 25.5 | 280.5 | 52.8 | — | 148.1 |
| 9 | 1000 | 22.2 | 241.0 | 57.4 | — | 138.3 |
| 10 | 1000 | 19.1 | 204.7 | 63.0 | — | 129.0 |
| 11 | 1000 | 15.0 | 158.1 | 70.4 | — | 111.3 |
| 12 | 1000 | 8.8 | 90.5 | 84.3 | — | 76.3 |
| 13 | 1000 | 2.3 | 23.0 | 92.9 | — | 21.4 |
| 14 | 1000 | 0.7 | 7.0 | 87.1 | — | 6.1 |

TABLE NO. V-A

Summation of Fractions

| Composite Fractions | Gms DSB Fructose | Gms DSB Total | % Fructose |
|---|---|---|---|
| Feed | 955.2 | 2206.0 | 43.3 |
| 2-14 | 949.5 | 2173.0 | 43.7 |
| 3-14 | 949.4 | 2158.0 | 44.0 |
| 4-14 | 946.3 | 2095.0 | 45.2 |
| 5-14 | 934.9 | 1920.0 | 48.7 |
| 6-14 | 883.0 | 1640.0 | 53.8 |
| 7-14 | 769.8 | 1317.0 | 58.4 |
| 8-14 | 630.4 | 1005.0 | 62.7 |
| 9-14 | 482.4 | 724.0 | 66.6 |
| 10-14 | 344.0 | 483.0 | 71.2 |
| 11-14 | 215.1 | 279.0 | 77.2 |
| 12-14 | 103.8 | 120.5 | 86.1 |
| 13-14 | 27.5 | 30.0 | 91.6 |

A fructose-dextrose syrup can be obtained which contains a fructose content ranging from 5.0–92.0% by combining the appropriate fractions or using a single fraction.

Theoretically, if 100% of the available fructose in a 43.3% fructose feed were recovered in a 55% fructose product composite that composite would contain a maximum of 78.7% of the total dry solids in the feed. This 78.7% represents the maximum amount recoverable based on the foregoing feed and product fructose composition.

EXAMPLE NO. 6

This example shows the enrichment of fructose from an enzyme isomerized fructose-dextrose syrup with a fructose content of 48.5% on a 5 ft. column.

About 4732 cc of a fructose-dextrose syrup containing 48.5% fructose is transferred to an exclusion column at a rate of 0.5 gal./min./ft.$^2$. The syrup is washed from the column with deionized water at the same rate. The first fraction eluted contains about 5000 cc of sugar-free water. Next, successive 1000 cc fractions are collected separately and the sugar content determined by methods known in the art. Following are the operating conditions used in this example. The analyses of the collection fractions are shown in Table VI. Table VI-B shows a summation of fractions to yield a high fructose syrup. The last fraction is combined with each preceding fraction.

| OPERATING CONDITIONS | |
|---|---|
| Pressure | Atmospheric |
| Temp. | 125° F. |
| Flow Rate | 0.5 gal./min./ft.$^2$ |
| Column Diameter | 4.0 inches |
| Resin Bed Depth | 60.0 inches |
| Resin | Dowex 50 w - X4, Ca++, 50–100 mesh |
| Bed Loading Volume | 38% of resin volume at 40.0% DSB |
| Feed Syrup | Enzyme Isomerized |
| Fructose | 48.5 |
| DSB | 39.9 |
| pH | 3.8 |
| Volume (cc) | 4732. |

TABLE VI

| Fraction | Volume cc | % DSB | Gms DSB | % Fructose | Gms DSB Fructose |
|---|---|---|---|---|---|
| Feed | 4732 | 39.9 | 2206 | 48.5 | 1069.9 |
| Occluded | 5000 | — | — | — | — |
| 1 | 1000 | 0.7 | 7.0 | — | — |
| 2 | 1000 | 1.7 | 17.0 | 0.4 | 0.1 |
| 3 | 1000 | 7.2 | 73.6 | 4.3 | 3.2 |
| 4 | 1000 | 16.9 | 179.5 | 9.2 | 16.5 |
| 5 | 1000 | 25.2 | 276.9 | 23.4 | 64.8 |
| 6 | 1000 | 29.2 | 326.2 | 41.4 | 135.1 |
| 7 | 1000 | 27.7 | 307.5 | 53.0 | 163.0 |
| 8 | 1000 | 25.1 | 275.7 | 59.6 | 164.3 |
| 9 | 1000 | 22.5 | 244.6 | 63.5 | 155.3 |
| 10 | 1000 | 19.3 | 207.0 | 71.0 | 147.0 |
| 11 | 1000 | 14.7 | 154.8 | 78.9 | 122.1 |
| 12 | 1000 | 8.5 | 87.3 | 90.5 | 79.0 |
| 13 | 1000 | 1.9 | 19.0 | 95.0 | 18.0 |
| 14 | 1000 | 0.6 | 6.0 | 88.4 | 5.3 |

TABLE VI-A

| Composite Fractions | Summation of Fractions: Gms DSB Fructose | Total Gms DSB | % Fructose |
|---|---|---|---|
| Feed | 1069.9 | 2206.0 | 48.5 |
| 2-14 | 1073.6 | 2175.0 | 49.4 |
| 3-14 | 1073.6 | 2158.0 | 49.7 |
| 4-14 | 1070.4 | 2084.0 | 51.3 |
| 5-14 | 1053.9 | 1905.0 | 55.3 |
| 6-14 | 989.1 | 1628.0 | 60.8 |
| 7-14 | 854.1 | 1302.0 | 65.6 |
| 8-14 | 691.1 | 994.0 | 69.5 |
| 9-14 | 526.8 | 719.0 | 73.3 |
| 10-14 | 371.5 | 474.0 | 78.4 |
| 11-14 | 224.5 | 267.0 | 84.0 |
| 12-14 | 102.4 | 112.3 | 91.1 |
| 13-14 | 23.4 | 25.0 | 93.4 |

A fructose-dextrose syrup can be obtained which contains a fructose content ranging from 4.0% to 95.0% by combining the appropriate fractions or using a single fraction.

In the case of a 48.5% fructose feed the theoretical maximum amount of 55% fructose sugar composite that can be recovered is 87% of the total dry solids in the feed. This compares with 78.7% for the 43.3% fructose feed in Example No. 5. The advantages of a higher fructose feed thus become apparent.

EXAMPLE NO. 7

This example shows the enrichment of fructose from an enzyme isomerized fructose-dextrose syrup with a fructose content of 41.9% on a 10 ft. column.

About 2340 cc of a fructose-dextrose syrup containing 41.9% fructose is transferred to an exclusion column at a rate of 0.2 gal./min./ft.$^2$. The syrup is washed from the column with deionized water at the same rate. The first fraction eluted contains about 2000 cc of sugar-free water. Next, successive 250 cc fractions are collected separately and the sugar content determined by methods known in the art. Following are the operating conditions used in this example. The analyses of the collected fractions are shown in Table VII.

Table VII-A shows a summation of fractions to yield a higher percentage fructose syrup. The last fraction is combined with each preceding fraction.

The basic principle for obtaining a syrup which is enriched in fructose has been outlined in this example using a 10 ft. column. A fructose-dextrose syrup can be obtained which has a fructose content ranging from about 2% to about 100% by combining the appropriate fractions or using a single fraction.

| OPERATING CONDITIONS | |
|---|---|
| Process Operation | Hydraulic Dome |
| Temp. | 72 to 75° F. |
| Flow Rate | 0.2 gal./min./ft.$^2$ |
| Column Diameter | 2.0 inches |
| Resin Bed Depth | 120 inches |
| Resin | Dowex 50 w - X4, Ca++ form, 50–100 mesh |
| Bed Loading Volume | 38% of resin volume at 40% DSB |
| Feed Syrup | Enzyme Isomerized |
| D.E. | 93.4 |
| Fructose | 41.9 |
| Dextrose | 52.8 |
| DSB | 40.0 |
| pH | 3.9 |
| Volume (cc) | 2340 |

TABLE VII

| Fraction | Volume cc | DSB | Gms DSB | % Fructose | Gms DSB Fructose |
|---|---|---|---|---|---|
| Feed | 2340 | 40.0 | 1094.0 | 41.9 | 458.4 |
| Occluded | 2000 | — | — | — | — |
| 1 | 250 | 0.1 | — | — | — |
| 2 | 250 | 0.7 | 1.7 | — | — |
| 3 | 250 | 1.3 | 3.2 | — | — |
| 4 | 250 | 1.7 | 4.2 | — | — |

TABLE VII-continued

| Fraction | Volume cc | DSB | Gms DSB | % Fructose | Gms DSB Fructose |
|---|---|---|---|---|---|
| 5 | 250 | 2.2 | 5.5 | 1.2 | 0.1 |
| 6 | 250 | 4.7 | 11.9 | 1.8 | 0.2 |
| 7 | 250 | 10.2 | 26.4 | 2.4 | 0.6 |
| 8 | 250 | 16.5 | 43.7 | 2.1 | 0.9 |
| 9 | 250 | 20.8 | 56.1 | 2.0 | 1.1 |
| 10 | 250 | 23.4 | 63.8 | 2.4 | 1.5 |
| 11 | 250 | 24.8 | 68.0 | 4.8 | 3.3 |
| 12 | 250 | 26.8 | 74.1 | 13.0 | 9.6 |
| 13 | 250 | 29.9 | 83.7 | 26.1 | 21.8 |
| 14 | 250 | 30.9 | 86.9 | 39.2 | 34.1 |
| 15 | 250 | 30.6 | 86.0 | 52.4 | 45.1 |
| 16 | 250 | 28.9 | 80.6 | 60.4 | 48.7 |
| 17 | 250 | 26.9 | 74.4 | 64.4 | 47.9 |
| 18 | 250 | 25.5 | 70.1 | 67.2 | 47.1 |
| 19 | 250 | 23.8 | 65.0 | 78.4 | 51.0 |
| 20 | 250 | 19.6 | 52.6 | 86.5 | 45.5 |
| 21 | 250 | 14.3 | 37.6 | 90.3 | 34.0 |
| 22 | 250 | 11.1 | 28.8 | 97.5 | 28.1 |
| 23 | 250 | 7.6 | 19.4 | 98.0 | 19.0 |
| 24 | 250 | 3.5 | 8.8 | 98.5 | 8.7 |
| 25 | 250 | 0.9 | 2.2 | 100.0 | 2.2 |

TABLE VII-A

| Composite Fractions | Summation of Fractions: Gms DSB Fructose | Total Gms DSB | % Fructose |
|---|---|---|---|
| Feed | 458.4 | 1094.0 | 41.9 |
| 2-25 | 450.5 | 1054.7 | 42.7 |
| 3-25 | 450.5 | 1053.0 | 42.8 |
| 4-25 | 450.5 | 1049.8 | 42.9 |
| 5-25 | 450.5 | 1045.6 | 43.1 |
| 6-25 | 450.4 | 1040.1 | 43.3 |
| 7-25 | 450.2 | 1028.2 | 43.8 |
| 8-25 | 449.6 | 1001.8 | 44.9 |
| 9-25 | 448.7 | 958.1 | 46.8 |
| 10-25 | 447.6 | 902.0 | 49.6 |
| 11-25 | 446.1 | 838.2 | 53.2 |
| 12-25 | 442.8 | 770.2 | 57.5 |
| 13-25 | 433.2 | 696.1 | 62.2 |
| 14-25 | 411.4 | 612.4 | 67.1 |
| 15-25 | 377.3 | 525.5 | 71.8 |
| 16-25 | 332.2 | 439.5 | 75.6 |
| 17-25 | 283.5 | 358.9 | 79.0 |
| 18-25 | 235.6 | 284.5 | 82.8 |
| 19-25 | 188.5 | 214.4 | 87.9 |
| 20-25 | 137.5 | 149.4 | 92.0 |
| 21-25 | 92.0 | 96.8 | 95.0 |
| 22-25 | 58.0 | 59.2 | 98.0 |
| 23-25 | 29.9 | 30.4 | 98.4 |
| 24-25 | 10.9 | 11.0 | 99.1 |

EXAMPLE NO. 8

This example shows the enrichment of fructose from an enzyme isomerized fructose-dextrose syrup having a fructose content of 48.8% on a ten-foot column. Using a hydraulic dome process and the operating conditions hereinafter set forth, 2340 cc of feed is separated into fractions set out in Table VIII. Table VIII-A is summation of the various fractions whose analysis is given in Table VIII.

| OPERATING CONDITIONS | |
|---|---|
| Process Operation | Hydraulic Dome |
| Tem. (°F.) | Ambient |
| Flow Rate | 0.2 gal./min./ft.$^2$ |
| Column Diameter | 2.0 inches |
| Resin Bed Depth | 120 inches |
| Resin | Dowex 50 w - X4, Ca++ form, 50–100 mesh |
| Bed Loading Volume | 38% of resin volume at 40% DSB |

-continued

| OPERATING CONDITIONS | |
|---|---|
| Feed Syrup | Enzyme Isomerized |
| Fructose | 48.8 |
| DSB | 40.0 |
| pH | 3.9 |
| Volume (cc) | 2340. |

TABLE VIII

| Fraction | Volume cc | DSB | Gms DSB | % Fructose | Gms DSB Fructose |
|---|---|---|---|---|---|
| Feed | 2340 | 40.0 | 1094.0 | 48.8 | 533.9 |
| Occluded | 2000 | — | — | — | — |
| 1 | 250 | — | — | — | — |
| 2 | 250 | 0.3 | — | — | — |
| 3 | 250 | 0.7 | 1.7 | — | — |
| 4 | 250 | 0.9 | 2.2 | — | — |
| 5 | 250 | 1.3 | 3.2 | — | — |
| 6 | 250 | 3.3 | 8.3 | — | — |
| 7 | 250 | 8.5 | 21.8 | — | — |
| 8 | 250 | 14.7 | 38.7 | — | — |
| 9 | 250 | 19.1 | 51.2 | 1.9 | 1.0 |
| 10 | 250 | 21.4 | 57.9 | 2.5 | 1.5 |
| 11 | 250 | 23.0 | 62.7 | 6.1 | 3.8 |
| 12 | 250 | 25.8 | 71.1 | 17.2 | 12.2 |
| 13 | 250 | 29.4 | 82.2 | 34.8 | 28.6 |
| 14 | 250 | 29.7 | 83.1 | 52.1 | 43.3 |
| 15 | 250 | 29.4 | 82.2 | 58.9 | 48.4 |
| 16 | 250 | 28.6 | 79.7 | 63.7 | 50.8 |
| 17 | 250 | 26.7 | 73.8 | 71.6 | 52.8 |
| 18 | 250 | 23.2 | 63.2 | 74.8 | 47.3 |
| 19 | 250 | 20.0 | 53.8 | 77.6 | 41.7 |
| 20 | 250 | 17.9 | 47.7 | 78.5 | 37.5 |
| 21 | 250 | 15.7 | 41.5 | 79.0 | 32.8 |
| 22 | 250 | 14.2 | 37.3 | 79.3 | 29.6 |
| 23 | 250 | 12.7 | 33.2 | 81.4 | 27.0 |
| 24 | 250 | 11.1 | 28.8 | 84.2 | 24.3 |
| 25 | 250 | 9.6 | 24.8 | 86.9 | 21.5 |
| 26 | 250 | 7.1 | 18.1 | 95.0 | 17.2 |
| 27 | 250 | 1.7 | 4.2 | 100.0 | 4.2 |

TABLE VIII-A

| Composite Fractions | Summation of Fractions: Gms DSB Fructose | Total Gms DSB | % Fructose |
|---|---|---|---|
| Feed | 533.9 | 1094.0 | 48.8 |
| 3-27 | 525.4 | 1071.3 | 49.0 |
| 4-27 | 525.4 | 1070.6 | 49.1 |
| 5-27 | 525.4 | 1068.4 | 49.2 |
| 6-27 | 525.4 | 1065.1 | 49.3 |
| 7-27 | 525.4 | 1056.8 | 49.7 |
| 8-27 | 525.4 | 1035.0 | 50.8 |
| 9-27 | 525.4 | 996.3 | 52.7 |
| 10-27 | 524.5 | 945.1 | 55.5 |
| 11-27 | 523.0 | 887.2 | 58.9 |
| 12-27 | 519.2 | 824.6 | 63.0 |
| 13-27 | 507.0 | 753.5 | 67.3 |
| 14-27 | 478.4 | 671.4 | 71.2 |
| 15-27 | 435.1 | 588.2 | 74.0 |
| 16-27 | 386.7 | 506.1 | 76.4 |
| 17-27 | 335.9 | 426.4 | 78.8 |
| 18-27 | 283.1 | 352.6 | 80.3 |
| 19-27 | 235.8 | 289.4 | 81.5 |
| 20-27 | 194.1 | 235.6 | 82.4 |
| 21-27 | 156.6 | 187.9 | 83.3 |
| 22-27 | 123.8 | 146.4 | 84.6 |
| 23-27 | 94.2 | 109.1 | 86.4 |
| 24-27 | 67.2 | 75.9 | 88.5 |
| 25-27 | 43.0 | 47.1 | 91.2 |
| 26-27 | 21.5 | 22.4 | 95.9 |

EXAMPLE NO. 9

This example depicts the separation pattern covering an entire run. A single flow rate is used to depict the sugar composition of all of the fractions. The process of Examples No. 3, 5 and 6 is used.

| OPERATING CONDITIONS | |
|---|---|
| Pressure | Atmospheric |
| Temp. | 125° F. |
| Flow Rate | 0.8 gal./min./ft.$^2$ |
| Column Diameter | 4 inches |
| Resin Bed Depth | 60 inches |
| Resin | Dowex 50 w - X4, Ca++ form 50–100 mesh |
| Bed Loading Volume | 38% of resin bed volume |
| Rinse Water | Deionized Water |

TABLE IX

| Fraction | Vol. cc. | DSB % | % Dextrose | % Fructose |
|---|---|---|---|---|
| Feed | 4732 | 39.9 | 52.1 | 42.5 |
| Occluded | 7000 | — | — | — |
| 1 | 1000 | 4.8 | 64.8 | 3.0 |
| 2 | 1000 | 13.4 | 78.7 | 7.4 |
| 3 | 1000 | 22.5 | 75.0 | 16.4 |
| 4 | 1000 | 25.9 | 63.0 | 32.0 |
| 5 | 1000 | 24.5 | 53.8 | 43.2 |
| 6 | 1000 | 22.2 | 49.9 | 46.7 |
| 7 | 1000 | 20.0 | 47.5 | 52.0 |
| 8 | 1000 | 17.9 | 43.3 | 56.7 |
| 9 | 1000 | 16.5 | 40.0 | 60.9 |
| 10 | 1000 | 13.5 | 33.8 | 66.5 |
| 11 | 1000 | 8.7 | 28.7 | 70.0 |
| 12 | 1000 | 6.6 | 10.4 | 72.9 |
| 13 | 1000 | 3.8 | 5.0 | 83.0 |
| 14 | 1000 | 1.0 | 1.4 | 91.0 |
| 15 | 1000 | 0.4 | — | — |

Fractions 1–4 represent 70.5% dextrose, 20% fructose and contain 32.5% of the total dry solids in the feed.

Product fractions 5–14 represent 55.7% fructose, 41.9% dextrose and contain 65.5% of the total dry solids in the feed.

Fractions 5–14 are 97.6% dextrose and fructose, 2.4% higher sugar vs. 5.5% higher sugars in the feed.

EXAMPLE NO. 10

This example shows production of 55% fructose syrup by a dual flow rate process. The process of Example Nos. 3, 5, 6 and 9 are used.

| OPERATING CONDITIONS | |
|---|---|
| Pressure | Atmospheric |
| Temp. | 125° F. |
| Flow Rate | 0.2–1.82 gal./min./ft.$^2$ |
| Column Diameter | 4 inches |
| Resin Bed Depth | 60 inches |
| Feed | 4818 cc. 39.3% DSB, 42.5 fructose |
| Rinse | Deionized Water |
| Resin | Dowex 50 w - X4, Ca++ form 50–100 mesh |
| Bed Loading Volume | 38% of resin volume at 40% DSB |

TABLE X

| Fraction | Vol. (cc) | DSB | Flow Rate gal./min./ft.$^2$ | Total Gms DSB | % Fructose | Gms Fructose |
|---|---|---|---|---|---|---|
| Feed | 4818 | 39.3 | 0.2 | 2206 | 42.5% | 937.6 |
| Occluded | 7000 | — | 0.2 | — | — | — |
| 1 | 1000 | 2.1 | 0.2 | — | 5.0% | — |
| 2 | 1000 | 7.8 | 0.2 | — | — | — |

TABLE X-continued

| Fraction | Vol. (cc) | DSB | Flow Rate gal./min./ft.$^2$ | Total Gms DSB | % Fructose | Gms Fructose |
|---|---|---|---|---|---|---|
| 3 | 1000 | 18.6 | 0.2 | — | — | — |
| 4 | 1000 | 25.9 | 0.2 | — | — | — |
| 5-11 | 7000 cc | 20.7 | 1.82 | 1510.3 | 55.0 | 830.7 |

EXAMPLE NO. 11

This example shows production of an approximately 55% fructose syrup fraction containing less than 2% non-monosaccharides. The range of non-monosaccharides in the high fructose product syrup is about 0.5–2.0%.

Run (A)

| Operating Conditions | | Feed |
|---|---|---|
| Col. Dia. - 4"<br>Bed Depth - 5'<br>Temp. 125° F. | Rinse-Deionized Water<br>Flow - 0.2 GPM/ft.$^2$ | 4719 cc<br>40% DSB<br>41% Fructose<br>53.4% Dextrose<br>5.4% Non-monosaccharides |

Recovery

| Fractions | DSB | Mono-saccharides | Dextrose | Fructose | Non-mono-saccharides |
|---|---|---|---|---|---|
| 6-11 | 20.7 | 98.1% | 45.9% | 53.1% | 1.9% |
| 1-5 | 16.3 | 92.0% | 76.1% | 15.9% | 7.8% |

Run (B)

| Operating Conditions | | Feed |
|---|---|---|
| Col. Dia. 4"<br>Bed Depth 5'<br>Temp. 125° F. | Rinse-Deionized Water<br>Flow - 0.5 GPM/ft.$^2$ | 4719 cc<br>40% DSB<br>41.2% Fructose<br>54.3% Dextrose<br>5.4% Non-monosaccharides |

Recovery

| Fractions | DSB | Mono-saccharides | Dextrose | Fructose | Non-mono-saccharides |
|---|---|---|---|---|---|
| 6-13 | 16.9% | 98.8% | 44.4% | 54.4% | 1.2% |
| 1-5 | 12.2% | 86.1% | 73.8% | 12.3% | 12.9% |

All analyses were run by gas chromatograph.

This invention is intended to cover all changes and modifications of the examples of the invention herein chosen for purposes of the disclosure which do not constitute departures from the spirit and scope of the invention.

What is claimed is:

1. A method of making a high fructose starch conversion syrup including the steps of passing a starch conversion feed syrup having a solids content of 10% to 70% and a dextrose content of above about 49% and a fructose content of above about 25% with less than about 10% higher molecular weight sugars through a molecular exclusion column containing polystyrene divinyl benzene resin in the calcium, barium or strontium form having about 2% to 12% cross-linkage and of about 20 to about 400 mesh in size, at a temperature of about 40° to about 180° F. and a flow rate of about 0.2 to about 6 gal./min./ft.$^2$ adding rinse water to the top of the column, recovering a first composite fraction containing about 50% to about 99% dextrose, about 1% to about 49% fructose and most of the higher sugars and recovering a second composite fraction consisting essentially of more than about 52% fructose, less than about 48% dextrose and less than about 2% higher molecular weight sugars.

2. The method of claim 1 wherein the second composite fraction contains less than about 2% higher molecular weight sugars.

3. The method of claim 1 wherein the first composite fraction includes 0.1% to about 50% higher saccharides.

4. The method of claim 1 in which the molecular exclusion column contains polystyrene divinyl benzene resin in the calcium form.

5. The method of claim 1 wherein the syrup flow rate is about 0.6 to about 2 gal./min./ft.$^2$.

6. The method of claim 1 including the step of concentrating the composite fraction to at least about an 80% solids syrup which is non-crystallizing on standing.

7. The process of claim 1 wherein the composite fraction is recovered after only one pass through the molecular exclusion column.

8. The process of claim 1 wherein the feed concentration is above about 40% dsb.

9. The method of claim 1 including the step of changing the rinse water flow rate after the first composite fraction is recovered.

10. The method of claim 9 wherein the rinse water flow rate is increased after the first composite fraction is recovered.

11. The method of claim 1 in which the feed syrup is fed into a water-filled column and including the steps of first discharging water from the column at the downstream end, and thereafter discharging a first composite fraction containing about 51% to 99% dextrose and 1% to 49% fructose and 0.1% to 50% higher saccharides, adding deionized rinse water to the top of the column after the feed syrup has been fed in, increasing the flow rate through the column at the appropriate cutoff point when the first composite fraction has been recovered, and recovering the said second composite fraction which represents about 52% to about 90% fructose and is forced through the column by the deionized water at a flow rate of about 0.2 to about 36 gal./min./ft.$^2$.

12. The method of claim 11 in which the rinse flow cycle is terminated when the solids in the second fraction drops below 1% on a dry solids basis.

13. The method of claim 11 wherein the column contains molecular exclusion resin, the feed syrup is distributed to the molecular exclusion resin below the top surface of the resin, and wherein the rinse water is fed to the column into the space above the top surface of the resin and the top of the column.

14. A non-crystallizing syrup derived from a syrup having a D.E. of over 90 and a fructose content of less than 49%, said non-crystallizing syrup consisting essentially of, on a dry solids basis, from about 52% to about 95% fructose, less than about 48% dextrose and from about 0.5% to about 2% higher molecular weight sugars.

15. A non-crystallizing syrup as defined in claim 14 which has a fructose content of at least 55% and a non-crystallizing solids level of over 80% dry solids.

16. A process for producing a fructose rich non-crystallizing syrup derived from starch comprising the steps of:

(a) passing a starch conversion syrup feed having on a dry solids basis more than 49% dextrose, about 25 to 51% fructose and about 0.1 to about 8% higher saccharides through a molecular exclusion column, (b) removing dextrose and higher saccharides from the syrup, and (c) recovering a product containing more than about 52% fructose, less than about 48% dextrose and less than about 2% higher saccharides.

17. The process of claim 16 wherein the recovered product contains about 55% fructose.

18. The process of claim 16 wherein the feed contains about 40–51% fructose.

19. The process of claim 16 wherein the dextrose and higher saccharides are removed as a first composite fraction containing about 50% to about 99% dextrose, about 1% to about 49% fructose and about 0.1% to about 50% higher saccharides and the product contains about 52% to about 90% fructose.

20. The process of claim 16 wherein the feed has a solids content of about 10% to about 70% on a dry solids basis.

* * * * *

UNITED STATES PATENT AND TRADEMARK OFFICE

CERTIFICATE OF CORRECTION

PATENT NO. : 4,395,292

DATED : July 26, 1983

INVENTOR(S) : Edward Katz, Henry S. Davis and Barrett L. Scallet

It is certified that error appears in the above-identified patent and that said Letters Patent is hereby corrected as shown below:

Column 8, line 39 in TABLE III-B under the title "%Fructose", "69.7" should be "63.2" and under the title "%Dextrose", "30.7" should be "36.9".

Column 9, line 49, "8.15%"should be "81.5%"

Signed and Sealed this

*Eleventh* Day of *September 1984*

[SEAL]

*Attest:*

*Attesting Officer*

GERALD J. MOSSINGHOFF

*Commissioner of Patents and Trademarks*